US012071680B2

(12) United States Patent
Saw et al.

(10) Patent No.: US 12,071,680 B2
(45) Date of Patent: Aug. 27, 2024

(54) MECHANICALLY ALLOYED LI—SN—ZN

(71) Applicant: Lawrence Livermore National Security, LLC, Livermore, CA (US)

(72) Inventors: Cheng K. Saw, Livermore, CA (US); ByoungWoo William Choi, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 649 days.

(21) Appl. No.: 16/994,324

(22) Filed: Aug. 14, 2020

(65) Prior Publication Data

US 2022/0049328 A1 Feb. 17, 2022

(51) Int. Cl.
*C22C 24/00* (2006.01)
*C22C 1/04* (2023.01)

(52) U.S. Cl.
CPC ..... *C22C 24/00* (2013.01); *C22C 1/0408* (2013.01)

(58) Field of Classification Search
CPC ..... C22C 24/00
See application file for complete search history.

(56) References Cited

U.S. PATENT DOCUMENTS

| | | | | |
|---|---|---|---|---|
| 7,851,085 | B2 | 12/2010 | Obrovac et al. | |
| 9,130,231 | B2 | 9/2015 | Halalay et al. | |
| 10,326,131 | B2 | 6/2019 | Mitlin | |
| 2007/0048612 | A1 | 3/2007 | Nakajima et al. | |
| 2018/0219224 | A1* | 8/2018 | Esaki ..... | H01M 4/0452 |

FOREIGN PATENT DOCUMENTS

| | | | |
|---|---|---|---|
| EP | 0180144 | A1 | 5/1986 |
| WO | 2005048394 | A1 | 5/2005 |

OTHER PUBLICATIONS

Choi et al., "Experimental Investigation of Ternary Alloys for Fusion Breeding Blankets," Lawrence Livermore National Laboratory, Oct. 26, 2015, 16 Pages (Year: 2015).*
Huang et al., "Dead lithium phase investigation of Sn—Zn alloy as anode materials for lithium ion battery," Chinese Science Bulletin, 54 (2009) 1003-1008 (Year: 2009).*
Cai et al., "Preparation of W—Al—Mo ternary alloys by mechanical alloying," Journal of Alloys and Compounds, vol. 430, 2007, pp. 77-80.
Cohen et al., "Investigation of the ternary phase diagram of mechanically alloyed FeCuAg," Journal of Physics: Condensed Matter, vol. 9, 1997, pp. 3259-3276.
Costa et al., "Mechanical alloying in the Li—Sn system," Materials Letters: X, vol. 6, 2020, pp. 1-4.
Dunne et al., "Timely Delivery of Laser Inertial Fusion Energy (LIFE)," ANS Newsletter, Lawrence Livermore National Laboratory, Oct. 28, 2010, 11 pages.
Giancarli et al. "Candidate blanket concepts for a European fusion power plant study," Fusion Engineering and Design, vol. 49-50, 2000, pp. 445-456.
Gilman et al., "Mechanical Alloying," Annual Review of Materials Science, No. 13, 1983, pp. 279-300.
Jolodosky et al., "Neutronics Evaluation of Lithium-Based Ternary Alloys in IFE Blankets," Lawrence Livermore National Laboratory, Nov. 25, 2014, 39 pages.
Xie et al., "A retrospective on lithium-ion batteries," Nature Communications, 2020, pp. 1-4.
Manthiram, A., "An Outlook on Lithium Ion Battery Technology," ACS Central Science, vol. 3, 2017, pp. 1063-1069.
Nova et al., "Synthesis of Intermetallics in Fe—Al—Si System by Mechanical Alloying," Metals, vol. 9, 2019, pp. 1-14.
Park et al., "Anode performance of lithium-silicon alloy prepared by mechanical alloying for use in all-solid-state lithium secondary batteries," Japanese Journal of Applied Physics, vol. 53, 2014, 7 pages.
Raffray et al., "Breeding blanket concepts for fusion and materials requirements," Journal of Nuclear Materials, 2002, pp. 21-30.
Smith et al., "Blanket comparison and selection study—Final report," Argonne National Laboratory, ANL/FPP-84-1, vol. 3, Sep. 1984, 519 pages.
The Royal Swedish Academy of Sciences, "Lithium-Ion Batteries," The Royal Swedish Academy of Sciences, Nobel Prize in Chemistry, 2019, 14 pages.
Turchi, P.E.A., "Thermodynamic assessment of the ternary alloy system Li—Sn—Zn," LDRD-ENG-14-ER-035 Report, Lawrence Livermore National Laboratory, Apr. 14, 2014, 14 pages.
Wu et al., "Guidelines and trends for next-generation rechargeable lithium and lithium-ion batteries," Chemical Society Reviews, vol. 49, 2020, pp. 1569-1614.
Pobitschka et al., "A Contribution to the Knowledge of Ternary Intermetallic Lithium-Phases with Zinc (resp. Cadmium and Indium) and Tin or Lead," Anorg. Chem., Org. Chem., 1978, pp. 115-117.
Statement of Relevance of Non?Translated Foreign Documents.
Huang et al., "Dead lithium phase investigation of Sn—Zn alloy as anode materials for lithium ion battery," Chinese Science Bulletin, 2009, 2 pages.
Yang et al., "Magnetic properties of lithium zinc ferrites synthesized by microwave sintered method," AIP Advances, vol. 6, 2016, 6 pages.
Katscher et al., "About chalcogenide halides of trivalent chromium," Naturwissenschaften, vol. 53, 1966, pp. 361.
Okamoto, H., "Li—Zn (Lithium-Zinc)," Journal of Phase Equilibria and Diffusion vol. 33, No. 4, 2012, pp. 345.
Schwarz et al., "The Synthesis of Amorphous Ni—Ti Alloy Powders by Mechanical Alloying," Journal of Non-Crystalline Solids, vol. 76, 1985, pp. 281-302.
Zeng et al., "Lithium ferrite (Li0.5Fe2.5O4) nanoparticles as anodes for lithium ion batteries," RSC Advances, vol. 4, 2014, pp. 23145-23148.

(Continued)

*Primary Examiner* — Christopher S Kessler
(74) *Attorney, Agent, or Firm* — Zilka-Kotab, P.C.

(57) ABSTRACT

A product includes a ternary alloy consisting essentially of $Sn_4Li_{(4+x)}Zn_{(8-x)}$, where x=0 to <8. A method includes forming a ternary alloy using a mechanical alloying process. The ternary alloy consists essentially of $Sn_4Li_{(4+x)}Zn_{(8-x)}$, where x=0 to <8.

20 Claims, 10 Drawing Sheets

(56) References Cited

OTHER PUBLICATIONS

Quraishi et al., "Synthesis and Characterization of Lithium-Substituted Cu—Mn Ferrite Nanoparticles," Indian Journal of Materials Science, vol. 2013, 2013, 8 pages.
Sangster et al., "The Li—Sn (Lithium-Tin) System," Section II: Phase Diagram Evaluations, Journal of Phase Equilibria, vol. 19, No. 1, 1998, pp. 70-75.
Stegmaier te al., "Lithium-Stuffed Diamond Polytype Zn?Tt Structures (Tt=Sn, Ge): The Two Lithium?Zinc? Tetrelides Li3Zn2Sn4 and Li2ZnGe3," Inorganic Chemistry, vol. 52, pp. 2809-2816.
International Center for Diffraction Data—Powder Diffraction File (ICDD-PDF) for Lithium (Li): PDF#00-015-0401; Gates-Rector, S.; Blanton, T; "The Powder Diffraction File: A Quality Materials Characterization Database"; Powder Diffr. 2019, 34 (4), 352-360. https://doi.org/10.1017/S0885715619000812.
International Center for Diffraction Data—Powder Diffraction File (ICDD-PDF) for Zinc (Zn): PDF#00-004-0831; Gates-Rector, S.; Blanton, T; "The Powder Diffraction File: A Quality Materials Characterization Database"; Powder Diffr. 2019, 34 (4), 352-360. https://doi.org/10.1017/S0885715619000812.
International Center for Diffraction Data—Powder Diffraction File (ICDD-PDF) for Tin (Sn): PDF#00-004-0673); Gates-Rector, S.; Blanton, T; "The Powder Diffraction File: A Quality Materials Characterization Database"; Powder Diffr. 2019, 34 (4), 352-360. https://doi.org/10.1017/S0885715619000812.
International Center for Diffraction Data—Powder Diffraction File (ICDD-PDF) for Lithium Tin Zinc (Li3 Zn2 Sn4): PDF#00-020-3333(RDB); Gates-Rector, S.; Blanton, T; "The Powder Diffraction File: A Quality Materials Characterization Database"; Powder Diffr. 2019, 34 (4), 352-360. https://doi.org/10.1017/S0885715619000812.
Sankaranarayanan et al., "Lithium ferrite nanoparticles for ferrofluid applications," Journal of Magnetism and Magnetic Materials, vol. 252, 2002, pp. 7-9.
Lysenko et al., "Structural and magnetic properties of lithium-substituted ferrite ceramics sintered by continuous electron beam heating," Nuclear Inst. and Methods in Physics Research B, vol. 470, Mar. 2020, pp. 28-31.
Jolodosky et al., "Characterization of Tritium Breeding Ratio and Energy Multiplication Factor of Lithium-based Ternary Alloys in IFE Blankets," Symposium on Fusion Engineering, Jun. 2015, 7 pages.
Suryanarayana, C. "Mechanical Alloying: A Novel Technique to Synthesize Advanced Materials," AAAS Research, vol. 2019, No. 4219812, 2019, pp. 1-17.
Ahn et al., "Lithium Storage Properties of Ball Milled Ni-57 mass%Sn Alloy," Materials Transactions, vol. 43, No. 1, 2002, 4 pages.
Suryanarayana, et al., "Mechanically alloyed nanocomposites," Progress in Materials Science, vol. 58, 2013, 120 pages.
Latkowski et al., "Chamber design for the Laser Inertial Fusion Energy (LIFE) Engine," Fusion Science and technology, vol. 60, Jul. 2011, pp. 54-60.

* cited by examiner

| | # of atoms when filled | | if fully occupied | | | | formula | X | If fully occupied Simplified form | | | |
|---|---|---|---|---|---|---|---|---|---|---|---|---|
| | | | Sn | Li | Li | Zn | | | Sn | Li | Zn | %Li |
| | Sites | | a | b | c | d | | | a | b+c | d | |
| | | | | | | | | | | | | |
| Sample 622 | | | 4 | 4 | 8 | 4 | $Sn_2Li_6Zn_2$ | 8 | 2 | 6 | 2 | 60 |
| Sample 721 | | | 4 | 4 | 10 | 2 | $Sn_2Li_7Zn_1$ | 10 | 2 | 7 | 1 | 70 |
| | | | | | | | | | | | | |
| Sn stays at (000) | 4 | full | 4 | 4 | 0 | 8 | $Sn_4Li_4Li_0Zn_8$ | 0 | 1 | 1 | 2 | 25 |
| Li stays at (½,½,½) | 4 | full | 4 | 4 | 1 | 7 | $Sn_4Li_4Li_1Zn_7$ | 1 | 1 | 1.25 | 1.75 | 31.25 |
| Li/Zn (¼,¼,¼) | 4 | | 4 | 4 | 2 | 6 | $Sn_4Li_4Li_2Zn_6$ | 2 | 1 | 1.5 | 1.5 | 37.5 |
| Li/Zn (¾,¾,¾) | 4 | | 4 | 4 | 3 | 5 | $Sn_4Li_4Li_3Zn_5$ | 3 | 1 | 1.75 | 1.25 | 43.75 |
| | | | 4 | 4 | 4 | 4 | $Sn_4Li_4Li_4Zn_4$ | 4 | 1 | 2 | 1 | 50 |
| | | | 4 | 4 | 5 | 3 | $Sn_4Li_4Li_5Zn_3$ | 5 | 1 | 2.25 | 0.75 | 56.25 |
| | | | 4 | 4 | 6 | 2 | $Sn_4Li_4Li_6Zn_2$ | 6 | 1 | 2.5 | 0.5 | 62.5 |
| | | | 4 | 4 | 7 | 1 | $Sn_4Li_4Li_7Zn_1$ | 7 | 1 | 2.75 | 0.25 | 68.75 |
| | | | 4 | 4 | 8 | 0 | $Sn_4Li_4Li_8Zn_0$ | 8 | 1 | 3 | 0 | 75 |
| | | | | | | | | | | | | |
| Published1 | | | 4 | 4 | 3.72 | 4.28 | $SnLi_{1.93}Zn_{1.07}$ | 3.72 | 1 | 1.93 | 1.07 | 48.25 |
| Published2 | | | 4 | 4 | 4 | 4 | $SnLi_2Zn$ | 4 | 1 | 2 | 1 | 50 |

FIG. 9

MECHANICALLY ALLOYED LI—SN—ZN

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to ternary alloys comprising lithium (Li), tin (Sn), and zinc (Zn), and more particularly, this invention relates to ternary alloys comprising lithium, tin, and zinc formed by mechanical alloying.

BACKGROUND

Fossil fuels are made up of oil, coal, and natural gas originating from prehistoric plants and animals that died millions of years ago. These fossil fuels are the major source of power for the world. However, fossil fuels are a non-renewable resource which is forecasted to be depleted in a couple of decades. Fossil fuels also have significant unintended effects including polluting the environment resulting in global warming and the production of greenhouse gases. It would therefore be desirable to find a new energy source for the future. Nuclear energy, including fission and fusion, offers a solution as a potentially limitless sustainable energy supply. Fission reactors are currently operated throughout the world; however, there are concerns regarding their impact on the environment in terms of radiation safety and disposal of spent fuel.

Nuclear fusion could potentially provide a useful energy source and bypass the issues of radiation safety and the disposal of spent fuel. Fusion power is based on combining deuterium-tritium (DT), forming helium, and releasing a neutron and its binding energy. These reactions occur at extremely high pressure and temperature and are being investigated by many laboratories. The deuterium can be harnessed from seawater. Tritium is produced by harnessing the leftover neutrons from the neutron-lithium interaction. Therefore, lithium is incorporated into the breeding blanket that surrounds the fusion source.

Recent work proposed using an alloy of liquid Li—Sn as the breeder for the IFE power plant. The foregoing alloy did not meet the tritium breeding ratio (TBR) and energy multiplication requirements for fusion reactors. Other breeding blanket materials were considered but they involve lead (Pb) which is typically considered hazardous.

Breeding blankets based on Li—Sn are of limited utility due to the high chemical reactivity of Li with water and air. The addition of Zn into Li—Sn alloys shows promise as a breeder in inertial fusion energy (IFE) power plants. However, synthesis of ternary alloys by conventional melt mixing techniques is very difficult, if not impossible. An advantage of melt processing is that unwanted components are often separated and burnt off. However, melt processing is subject to contaminations and contaminants can react with other elements. In melt processing, the elements or compounds of the elements are brought together and heated to above their melting points. In the liquid state, the atoms are free to move around and are well-mixed in the liquid state. The components tend to phase separate upon cooling because formation of binary alloys is more favorable due to the mixing kinetics (temperature and compositions) and eutectic points (minimum energy configurations). Accordingly, a ternary alloy of Li—Sn—Zn has heretofore remained elusive.

In contrast, various aspects of the present disclosure provide an alternative method of synthesizing ternary alloys comprising Li, Sn, and Zn, using mechanical alloying, which overcomes the phase separation problem associated with melt processing techniques. Mechanical alloying was used to achieve a single cubic phase of the ternary alloy. The Zn-including ternary alloy proposed herein will satisfy the nuclear, thermal, and chemical requirements for a fusion reactor.

The ability to accommodate a relatively large amount of atomic Li in a structure without changing crystallographic phase would be advantageous in many areas, particularly in lithium-ion battery technology which is extensively used in a variety of everyday devices. Lithium has an advantage over other metals because it has the smallest atomic radii of the metals and lithium is the lightest metal. Lithium can be incorporated into alloy systems, for example, those including aluminum, thereby making the final product lighter and, in many cases, improving various physical properties. Lightweight alloys are particularly useful for the aerospace industries.

Due to their metallic nature, outer electrons can be easily moved from atom to atom, which is the basis for current flow in electricity power. Lithium flow is present during battery charging or discharging. A charged potential has to be developed between the anode and cathode, and, when connected to a device, electrons flow from the cathode to the anode, thereby developing a current flow. The cathode and the anode are embedded in various electrolytes where positive ions move from the cathode to the anode or from the anode to the cathode, e.g., depending on whether it is charging or discharging. In most cases, these electrolytes are in liquid form. Solid form electrolytes have also been developed particularly for small, mobile devices. Lithium ions are the smallest metallic atoms found to be stable and are used in lithium ion batteries. The small size is useful for easily transporting the ions through the electrolytes, thus requiring less resistance to cause the event.

Various aspects of the present disclosure focus on materials for battery technology (e.g., the cathode and the anode materials). Presently, the state-of-art cathode materials include lithium oxides, $LiCoO_2$, $LiMn_2O_4$, $Li(Ni_xMn_yCo_z)$, lithium (Li), cobalt (Co), manganese (Mn), or nickel (Ni). State-of-art anode materials are typically graphite, lithium-alloy materials, intermetallics or silicon. Even though battery technology continues to improve, there are several inherent problems. Some problems include material crystallographic phase stability, unnecessary development of new dead phases, thermal stability, changes in volume with temperature, over-heating, time considerations, and toxicity considerations. Further problems include insufficient charging and discharging capacity, insufficient number of useful cycling processes (e.g., charge and discharge), and cost considerations.

A ternary alloy without oxygen at the cathode would be advantageous for improving thermal conductivity, thereby reducing over-heating issues which are widely reported in recent airplane accidents. An alloy which can accommodate lithium ions without changing phase will improve the thermal stability which is critical in the prevention of cracks and explosions.

SUMMARY

A product, according to one aspect, includes a ternary alloy consisting essentially of $Sn_4Li_{(4+x)}Zn_{(8-x)}$, where x=0 to <8.

A method, according to another aspect, includes forming a ternary alloy using a mechanical alloying process. The ternary alloy consists essentially of $Sn_4Li_{(4+x)}Zn_{(8-x)}$, where x=0 to <8.

Various aspects of the present disclosure include ternary alloys comprising Li—Sn—Zn. Corresponding XRD results show that these alloys exist in single FCC phase and that Sn atoms reside in the (a) (0,0,0) sites, Li atoms reside in the (b) (½, ½, ½) sites and Li and Zn atoms may both reside in the (c) (¼, ¼, ¼), and (d) (¾, ¾, ¾) sites. If the sites are fully filled, the ternary alloys have the form of $Sn_4Li_4Li_xZn_{(8-x)}$ where x is from 0 to 8. This result indicates that the ternary alloy may be either stoichiometric or non-stoichiometric, suggesting that there is a wide range of lithium compositions which remain as a single FCC phase. The (c) and (d) sites may be overfilled (more than 1 atom per location) in some approaches.

By being a single phase, the material is expected to have good thermal stability. The materials were also synthesized as nanoparticles which are preferred for improved materials packing for battery anode applications.

The inventors believe there is chemical ordering where heating various ternary alloys past the melting point of the ternary alloy and cooling the ternary alloys to room temperature does not result in phase separation. The chemical ordering will be helpful to maintain proper mixing of the ternary alloy components to prevent any atomic segregation in the liquid stage when used as the nuclear blanket in the fusion reactor. Hence, the liquid alloy flow behavior will be properly regulated.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

FIG. 9 is a table including various ternary alloy compositions, according to various aspects of the presently disclosed inventive concepts.

DETAILED DESCRIPTION

Figure 1:
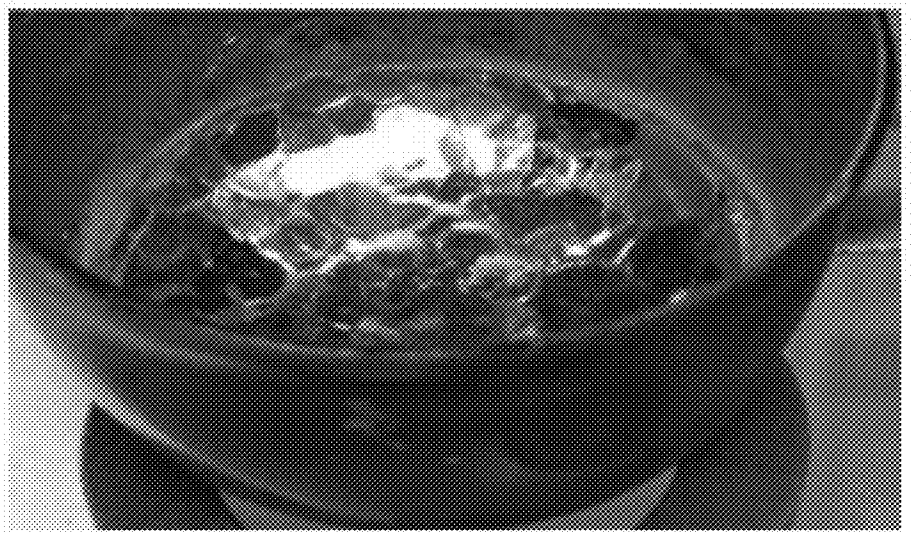
FIG. 1 is an image of the resulting material of melt processing, according to a comparative example.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. The term "about" as used herein indicates the value preceded by the term "about," along with any values reasonably close to the value preceded by the term "about," as would be understood by one of skill in the art. When not indicated otherwise, the term "about" denotes the value preceded by the term "about" ±10% of the value. For example, "about 10" indicates all values from and including 9.0 to 11.0.

The following description discloses several preferred aspects of ternary alloys comprising lithium, tin, and zinc formed by mechanical alloying and/or related systems and methods.

In one general aspect, a product includes a ternary alloy consisting essentially of $Sn_4Li_{(4+x)}Zn_{(8-x)}$, where x=0 to <8.

In another general aspect, a method includes forming a ternary alloy using a mechanical alloying process. The ternary alloy consists essentially of $Sn_4Li_{(4+x)}Zn_{(8-x)}$, where x=0 to <8.

Fusion power plants based on the deuterium-tritium (DT) fuel cycle breed the tritium fuel by neutron reactions with lithium (Li). Li is incorporated into the breeding blanket that surrounds the fusion source. Because of the chemical reactivity of Li with water and air, alternative, more stable, alloys based on Li, Si, and Zn are proposed herein.

As noted above, the most convenient method of synthesizing an alloy is by melt processing. However, melt processing is subject to contamination, and contaminants may react with other elements. Moreover, ternary alloys formed by melt processing tend to phase-separate upon cooling because formation of binary alloys is more favorable.

Accordingly, synthesis of ternary alloys by conventional melt mixing techniques is difficult if not impossible. To synthesize ternary alloys, conventional melt mixing is typically carried out at temperatures of about 800° C. in an argon-filled glove box. However, as mentioned above, melt synthesis of ternary alloys has heretofore not proven successful because of the competing kinetics and the ever-present phase separation inherent in melt synthesis.

Mechanical alloying (MA) refers to high energy ball-milling as a powder metallurgy methodology. Generally, MA includes applying high energy ball collisions to the sample in a confined space. The high energy ball collisions may be accomplished by mixing the powder samples with mechanically hard balls in a suitable container. In various approaches, mechanical alloying may be employed using conventional ball milling apparatuses, including stainless steel balls, ceramic tungsten carbide balls, flint balls, etc. A suitable container for mechanical alloying may comprise stainless steel, ceramic tungsten carbide, chrome-steel, etc. The container is agitated, e.g., vibrated, rotated, oscillated, etc., resulting in a series of collisions between the balls and/or the wall of the container that crush the material to be milled.

There is some ambiguity associated with understanding the mechanistic behavior which occurs during MA processing. MA processing may be used to pulverize chunks of material into powders and intimately mix the materials, thus improving mixing properties. It has been reasonably established that during milling, there exists localized high pressure and high temperature mixing. There may be fast quenching due to the relatively large thermal mass. At an atomistic level, MA is generally considered a process including the accumulation of structural defects in crystalline lattices, intimate mixing of elemental species at interfaces, hot spot theory, defect enhanced diffusion, shear-induced mixing, interface roughening and contact melting. In many instances, amorphous structures are also formed.

The atomic scale behavior of the materials during milling depends on the materials and any associated properties. For example, brittleness, malleability, reactivity, hardness, diffusivity, atomic radius, electron potentials, etc., or any combination thereof may influence the atomic scale activity during milling. MA presents a unique methodology for changing the structure and microstructure of the materials to achieve or improve upon any of the foregoing material properties.

For example, an iron-aluminum-silicon (Fe—Al—Si) system was synthesized by MA, and was found to have high temperature mechanical properties and oxidation resistance. In another example, a tungsten-aluminum-molybdenum (W—Al—Mo) system was synthesized by MA and was found to have an improved micro-hardness compared to the binary system. In yet another example, synthesis of an iron-copper-silver (Fe—Cu—Ag) system was carried out and found to have similar properties.

Various aspects of the present invention describe a method of synthesis for ternary alloys comprising Li, Sn, and Zn, by mechanical alloying, which overcomes the phase separation problem of previous attempts to create such ternary alloys. The inventors know of no other method which achieves the single phase ternary alloys described herein, including associated non-stoichiometric alloys.

The present disclosure compares the synthesis of the ternary alloys by high temperature melting and MA. As expected, melt processing resulted in phase separation upon cooling. The inventors observed that the resulting material formed by MA remained in single phase at all temperatures and is expected to have all the predicted thermal and chemical properties associated with the ternary alloy. Moreover, the resulting powder single phase ternary alloy is more manageable, in terms of thermal behavior, material homogeneity, and ultimately, flow, compared to the multiple-phase material synthesized by high temperature melting.

In various aspects, high purity Li, Sn, and Zn are added in the desired ratio to a container according to any approach described herein. In various aspects of the present disclosure, high purity refers to elements, samples, compounds, etc., which are greater than or equal to 99.9% purity. Chemical purity as used herein is characterized by having all atoms (or substantially all atoms) which have the same atomic number and/or the same number of protons.

The mechanical alloying process of the high purity metals in the container may be performed according to any approach described herein. The mechanical alloying process preferably includes high energy ball milling in an essentially inert atmosphere, e.g., of argon and/or other noble gas. The ball milling may be performed with conventional equipment known in the art, and a person having ordinary skill in the art would understand which equipment to select for scaling the production of the ternary alloy, based on the teachings herein. In preferred approaches, the ball milling is performed in an argon-filled container, such as a glove box. The milling may be performed for a length of time which is sufficient to result in a single face-centered cubic (FCC) phase of the ternary alloy. The amount of time for milling depends on various conditions including the volume of the vial, the number of balls, the size of the balls, the experimental parameters, the amount of initial materials which are used, the vial temperatures, the dimensions of the machine used, the dynamics of the machine used, including, but not limited to, the rotational speed, the velocity of the device arms, etc. The amount of time for milling would be readily determinable by one having ordinary skill in the art in view of the present disclosure. The single phase may be verified using x-ray diffraction (XRD) machines known in the art in at least some approaches. For example, the presence of new x-ray lines and the absence of the original XRD lines in the spectrum may be used to determine that the state of the initial material is converted.

In preferred aspects, a stream of cooled air may be provided during the mechanical alloying process. The vials for ball milling may be cooled prior to and/or during the milling process, in some approaches. In various approaches, the cooled air is at least cooler relative to the experimental environment. The vials tend to become warm during the milling process and it would be beneficial to pre-cool them as would become apparent by one having ordinary skill in the art upon reading the present disclosure.

The resulting ternary alloy formed by mechanical alloying is physically characterized as being in the form factor of a manageable powder. The resulting powder may be removed from the container. The resulting powder may be separated from the balls where ball milling is employed according to any technique known in the art. This powder is in sharp contrast to the physical characteristics of the result of melt processing experiments. The experimental result of melt processing requires intense scraping to be removed from the experimental equipment as described below.

The resulting ternary alloy formed by the mechanical alloying process comprises nanoparticles. The nanoscale size of the nanoparticles is a physical characteristic of forming the ternary alloy by mechanical alloying. An average particle diameter for the nanoparticles formed by the mechanical alloying process is between about 5 nm and about 10 nm. In preferred aspects, the average particle diameter for the nanoparticles formed by the mechanical alloying process is about 7 nm. The particle size may be determined from the peak width of the x-ray peaks using the Debye equation as would become apparent by one having ordinary skill in the art upon reading the present disclosure. In contrast, prior art melt processing products require further grinding to produce a powder form factor. The resulting powder (e.g., formed by prior art melt techniques) comprises different phases within any resulting nanoparticles.

The ternary alloy nanoparticles produced via the methods disclosed herein are physically characterized as having unique properties which are not present in any resulting product formed by melt processing. The manageable powder formed by mechanical alloying is physically characterized as being more stable, more controllable, characterized by more even thermal expansion, in a single phase, etc., compared to melt processing products. The single phase nanoparticles comprising each element in the ternary alloy is a physical characteristic of forming the ternary alloy by mechanical alloying according to the various approaches described herein.

The ternary alloy formed by mechanical alloying is physically characterized by not exhibiting phase separation upon heating to relatively high temperature and upon cooling to room temperature. In preferred aspects, the ternary alloy is physically characterized by remaining substantially in a single FCC phase upon heating to about 900° C. and upon cooling to about room temperature (e.g., about 20° C. to about 25° C.). In preferred aspects, the ternary alloy is physically characterized by remaining substantially in a single FCC phase upon heating to above the melting point of the ternary alloy. The melting point may be determined where the DSC scan exhibits the endotherm (e.g., see the dip in the DSC scan of FIG. 4). As the temperatures rise, the ternary alloy begins to melt at around 715° C. and is completely melted at around 760° C. There are no changes to the structure of the ternary alloy as it surpasses the melting point. The inventors were surprised that the ternary alloy remained in the single phase; phase separation that occurs in conventional melt processing techniques was expected. The inventors were further surprised that the ternary alloy remained physically characterized by the single phase upon cooling to room temperature.

The FCC structure of the ternary alloy comprises four available sites, and atoms sit in these positions in the unit cell defined as (a) (0,0,0), (b) (½, ½, ½), (c) (¼, ¼, ¼), and (d) (¾, ¾, ¾) sites. One class of product formed according to the methods described herein comprise Sn atoms sitting at the (a) sites, Li atoms on the (b) sites, and the "extra" Li and Zn atoms sharing the (c) and (d) sites. The additional Li and Zn atoms are interchangeable between the (c) and (d) sites. Each site contains four locations and each unit cell has four atoms per site for a total of 16 atoms. Accordingly, as would be understood by one having ordinary skill in the art, the product formed by the various aspects described herein may be stochiometric or non-stochiometric by filling or partially filling, respectively, various of the (a), (b), (c), and/or (d) sites. For example, sample 622 and sample 721 (to be discussed in detail below) are both non-stochiometric alloys having sites (c) and (d) partially filled, suggesting that the fractional composition can vary across a range without changing the cubic structure of the ternary alloy using mechanical alloying.

Specifically, if the (a) and (b) sites are filled, the resulting product is $Li_4Sn_4$ (e.g., LiSn). If (a), (b), (c), and (d) are filled, the resulting product is $Li_8Sn_4Zn_4$ (e.g., $Li_2SnZn$). Both of these products are stochiometric. In contrast, if both the (c) and (d) sites are partially filled (e.g., such as in sample 622 and sample 721), the resulting product is non-stochiometric. According to the aspects described above, the atomic populations may be defined as $Sn_{2.5}Li_{2.5}Li_{(x)}Zn_{(5-x)}$ where x=0, 1, 2, 3, 4, and 5. The maximum amount of Zn which can be added is 5 corresponding to when x=9 which is 50% atomic percentage and the maximum amount of Li atoms that can be added is 7.5 corresponding to when x=5 which is 75% atomic percentage.

Ternary alloys formed by mechanical alloying according to some of the processes described herein consist essentially of $Sn_4Li_{(4+x)}Zn_{(8-x)}$, where x=0 to <8. If x=0, then the alloy is $Sn_4Li_4Zn_8$ with x=0 being the theoretical minimum for the ternary alloy. If x=8, then the alloy is $Sn_4Li_{12}$ and the alloy is binary with x=8 being the theoretical maximum. In preferred approaches, for the ternary alloy consisting essentially of $Sn_4Li_{(4+x)}Zn_{(8-x)}$, where x is >0 and <8, the Li atoms may slide in and out during charging and discharging of the single phase cell. If only the (c) and the (d) sites are fully filled by only one atom in each site, then x is between 0 and 8. However, if the (c) and (d) sites are partially filled or overfilled, then x may be as high as 10 as indicated by sample 721. In this case, the overfilled sites are possible where Li atoms are inherently small in size and may be "dumped" into the FCC structure. Specifically, because of the size of the Li atoms, this single phase ternary alloy comprising, Li, Sn, and Zn is able to accommodate multiple atoms in the (c) and (d) sites, thereby making the resulting material unusually "Li-rich."

Various aspects of the present disclosure provide for non-stoichiometric ternary alloys, and methods for forming, such that the concentration may be varied without changing the phase of the ternary alloy. The non-stochiometric properties imply that Li—Sn—Zn ternary alloys may be synthesized with different compositions. Such non-stoichiometric ternary alloys are of particular interest for Li-ion battery anode applications where a small change in composition may drastically change the current capacity of the material. Anode materials are often the limiting factor in battery technology. The resulting powder form of the disclosed mechanical alloying process is more manageable than the resulting material formed by conventional high temperature melt processing techniques where further powder processing is performed.

According to the aspect described above, the atomic populations can be defined as $Sn_4Li_{(4+x)}Zn_{(8-x)}$ where x=0 to 8 if the sites are fully filled. The maximum amount of Zn that can be added is when x equals to 0, which is 50% and the maximum amount of Li that can be added is 75% when x equals to 8. Hence, the amount of lithium in the structure fluctuates between 25 atomic % to 75 atomic % depending on the x value (see the plot of FIG. 10 along the linear straight line). This is particularly important for charging and discharging batteries because the amount of lithium fluctuates while the structure remains in the single phase. Such behavior will be useful in physical thermal stability or the generation of additional phases which hinder the changing of lithium concentration during battery cycling.

Various aspects of the present methodology achieve a single cubic phase alloy powder with an average crystal size of about 7 nm with the lattice spacing of 6.51 nm. An average crystal size is preferably between about 5 nm and about 10 nm. The melting point for these nanoparticles is sufficiently high for additional processing. For example, additional processing may include annealing, sintering, etc. Furthermore, based on the nanoparticle structure of the ternary alloys, additional precursors and/or other elements may be added to tune the material properties of the alloys and/or bodies comprising the alloys, as described in detail below.

The techniques described herein have significant advantages over conventional methods. For example, the starting materials are sealed in the chamber, thus avoiding reactivity from the atmosphere (e.g., oxygen, nitrogen, etc.). Lithium is known to have high reactivity with these elements. The resulting material is in the form of a manageable powder which can further be processed using typical powder manufacturing techniques for forming rods, plates, films, etc., for various applications. The inventors do not know of any other technique for synthesizing single FCC phase Li—Sn—Zn alloys.

Various aspects of the MA processes described herein provide the ability to precisely control the composition of the ternary alloy material. The performance of materials formed by conventional methods is adversely affected by slight deviations in the compositions of the materials. For example, Huang et al., "Dead lithium phase investigation of Sn—Zn alloy as anode materials for lithium ion battery," Chinese Science Bulletin, 54 (2009) 1003-1008., concluded that $Li_xSn_4Zn_4$ (for x=2, 4, 6, 8) contributes to reversible capacity while a small change in the composition of $Li_xSn_4Zn_{(8-(x-4))}$ (for x=4.74, 4.72) led to capacity loss due to dead lithium phases during the cyclic process (e.g., charging and discharging). In contrast, the resulting ternary alloy produced by the various approaches described herein is not subject to impurities and the composition is precisely controllable for the intended application as would become apparent by one having ordinary skill in the art upon reading the present disclosure.

In various approaches, additional processing may be performed on the resulting powder ternary alloys as would become apparent to one skilled in the art upon being apprised of the preset disclosure. At least some of the methods disclosed herein may include sintering the resulting ternary alloy to join adjacent particles to form solid pieces and/or microstructures. The ternary alloy nanoparticles may be sintered to form anodes plates and/or rods by using temperature and pressure as would be understood by one having ordinary skill in the art. Due to the size and character of the nanoparticles comprising the ternary alloy, the grains in the sintered product are better mixed with each other, thereby making the system homogeneous and isotropic. The homogeneous and isotropic nature of the system improves thermal stability and would be an advantage during the cycling of battery charges in various anode battery applications.

In other approaches, sintering aids and/or precursors may be added to the nanoparticles to assist in various chemical interactions with and/or within the ternary alloy. For example, very small amounts of materials may be added to induce specific interactions. In another example, an exemplary processing aid may be a low molecular weight polymer which functions as a catalyst and/or assists in the atomic packing. The foregoing processing aid burns off during further heating and/or sintering, leaving no trace in the final product. The powder form of the ternary alloy formed by mechanical alloying may be consolidated using the foregoing techniques as would be understood by one having ordinary skill in the art.

The mechanical alloying synthesis of the ternary alloy may be used to manipulate the concentrations of Li and Zn in the ternary alloy. The concentration of the elements in the non-stochiometric ternary alloy described herein may be varied without changing the phase. This property is of interest for Li-ion battery anode applications where a small change in composition can drastically change the current capacity of the material. Anode materials are often the limiting factor in battery technology.

The Li atoms may be "pushed out" and the Zn atoms may be "let in" and vice versa for applications involving charging and discharging Li-ion batteries. The atoms are bound to the unit cell. The atoms do not form different phases at the anode causing thermal instabilities, dendritic growth, blisters, etc., which are problems currently facing battery technology. Li atoms do not float as free Li metal (e.g., which is very reactive to the electrolyte, air, moisture, etc.). The Li atoms slide in and out in the unit cell of the alloy. As a consequence, little energy is used for atomic substitution rather than for forming a new phase (e.g., the battery during the cycling is cooler which is relevant for safety concerns).

Due to the single phase nanoparticles comprising the ternary alloy formed by mechanical alloying, additional precursors, processing aids, and/or other elements may be added to a body comprising the ternary alloy to further tune the material properties of the ternary alloy. For example, in some applications, it may be desirable to add magnetic elements to achieve various properties. Exemplary magnetic elements include iron (Fe), cobalt (Co), chromium (Cr), nickel (Ni), etc. Due to the atomic arrangements described above, unique magnetic properties may be achieved. The amount of magnetic materials will depend on the intended application and would be determinable by one having ordinary skill in the art. At least some of the mechanical alloying processes as described herein may be used to form nanoparticle-containing ternary, quandary, etc., alloys comprising one or more elements including Fe, Co, Cr, Ni, etc.

In other exemplary applications, additional elements may be added to a body comprising the ternary alloy for tuning physical characteristics of the body and/or the ternary alloy including strength, weight, hardness, etc. The nanoparticles and thermal stability of the ternary alloy formed by the various aspects described herein provide the ability to tune such physical characteristics. For example, in one battery application, a small amount of carbon fibers (e.g., which do not play a role in the Li-ion interactions) may be added to increase the strength of a product consisting essentially of the ternary alloy. In other exemplary battery applications, copper and/or aluminum particles may be similarly added to the ternary alloy for adjusting the thermal conductivity of the material.

Samples of $Li_{60}Sn_{20}Zn_{20}$ and $Li_{70}Sn_{20}Zn_{10}$ were prepared according to the methods described herein. The resulting powders were examined using XRD and differential scanning calorimetry techniques. The results of these examinations showed that the samples comprise a single FCC cubic phase. The XRD analysis also suggests that Li and Zn atoms share occupancy in the tetrahedral sites while Sn atoms are located at the FCC 4a sites. The following experimental details are provided by way of example only, and should not be deemed limiting.

The experimental details provided below comprise non-limiting examples of fabrication of ternary alloys according various of the disclosed aspects. Procedures and parameters as suggested in the experimental sections below may be applied in various aspects of methods falling within the foregoing general methodology.

Experimental: Melt Processing

High purity elemental samples of Li, Sn, and Zn were purchased from a commercial supplier (Alfa Aesar®, 2 Radcliff Rd, Tewksbury, MA 01876, USA). The melt experiment was carried out in an argon-filled glove box. The materials were weighed using a precision microbalance according to the desired atomic ratio and mixed in a tantalum (Ta) crucible. The crucible was placed in a furnace which was heated up to about 900° C. for 3 hours. After high temperature melting and cooling to room temperature, the sample was removed from the furnace. The sample was observed to show crystalline domains as depicted in the image of FIG. 1.

The sample was essentially stuck to the Ta crucible. After a considerable amount of scraping, the sample was removed and loaded onto the differential scanning calorimetry (DSC) instrument located inside the glove box. The experiment was carried out using the NETZSCH® STA 449 F1 Jupiter®, High Temperature Differential Scanning calorimeter (DSC)

(NETZSCH® Instruments North America, LLC, 129 Middlesex Turnpike, Burlington, MA 01803, USA) which is capable of following phase transitions to above about 1000° C. as would be understood by one having ordinary skill in the art. The NETZSCH® STA 449 F1 Jupiter® was located inside the glove box to avoid air contamination.

Experimental: Mechanical Alloying

Figure 2:
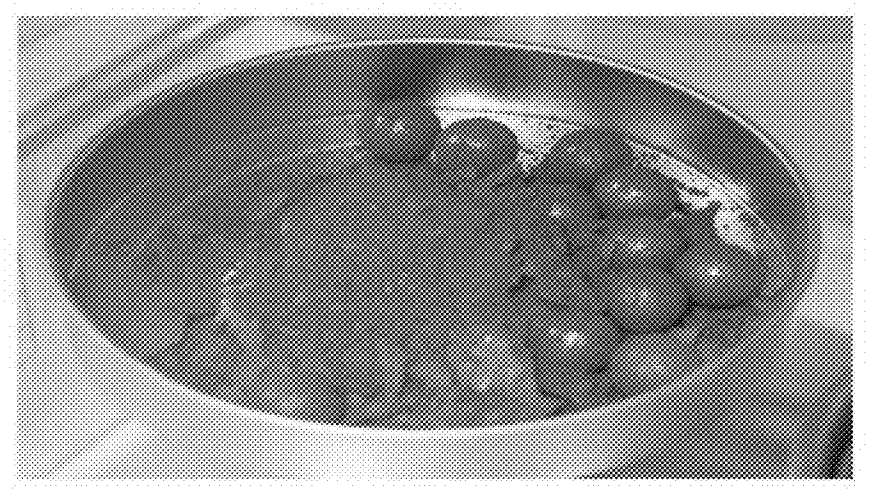
FIG. 2 is an image of the resulting material of mechanical alloying, according to one aspect of the presently disclosed concepts.

Samples of neat Li, Sn, and Zn in the atomic ratio of $Li_{60}Sn_{20}Zn_{20}$ and $Li_{70}Sn_{20}Zn_{10}$, referred to as sample 622 and sample 721, respectively, throughout the present disclosure, were prepared using mechanical alloying. For the MA process, the element samples were carefully weighed using a microbalance and loaded into the machine hardened steel vial in the glove box. The vials were sealed using "o" rings. MA was carried out in the duration of 6, 24, and 36 hours. The resulting powder is depicted in the image of FIG. 2.

MA of the powder was carried out using a commercial SPEX® 8000D Mixer/Mill® (SPEX® SamplePrep®, 65 Liberty Street, Metuchen, NJ 08840, USA). The cover was removed so that the vials were exposed to a stream of cooled air from a portable laboratory air-conditioner using two large air hoses. The cooling was carried out at all times during milling by adapting the two large air hoses from the exit points and directing them towards the vials. The temperature at the end of the air hoses was measured to be 9° C. Stainless steel (316L) balls (¼ inch diameter) were used. The vials were made of hardened steel.

Following the milling, the resulting powders were loaded onto a sealed sample holder and examined using a Bruker Discover XRD instrument (BRUKER AXS, LLC, 5465 East Cheryl Parkway, Madison, WI 53711-5373, USA), utilizing CuKa radiation. Step scans were performed from 10° to 80° (2θ) at 4 seconds acquisition time per step. The x-ray generator was set at 40 kiloelectron volt (keV) and 40 milliampere (mA).

Results

Figure 3:
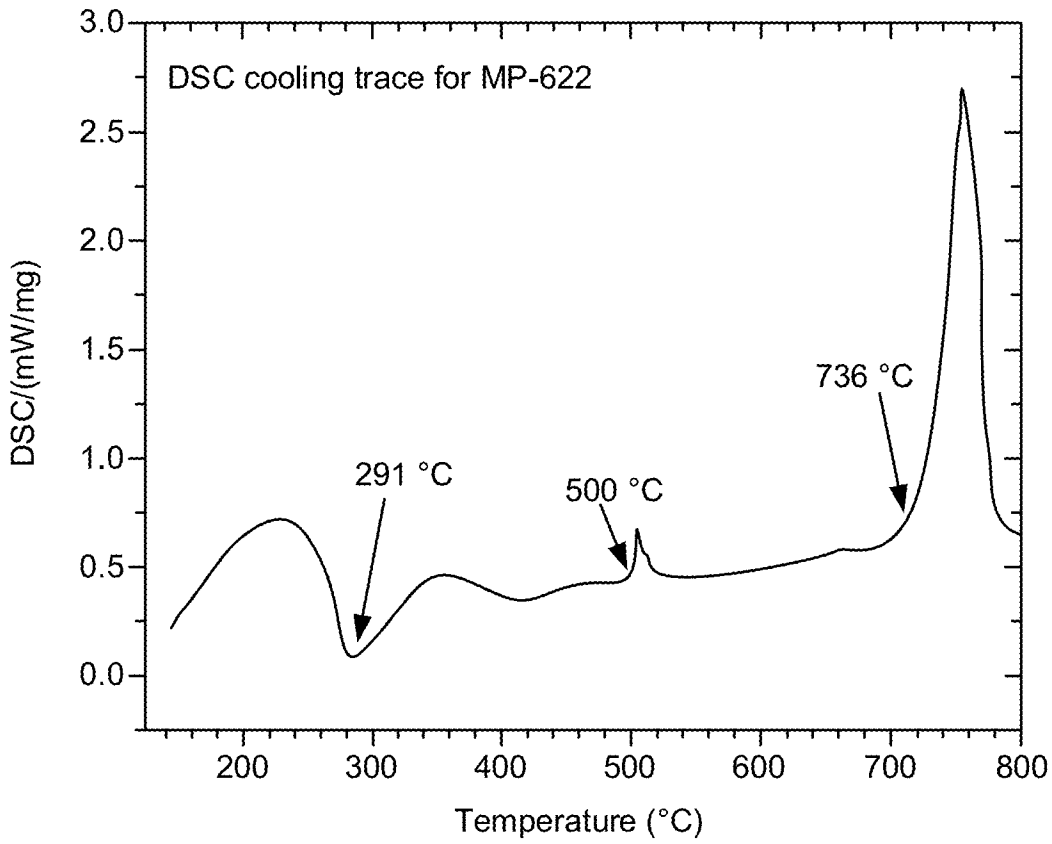
FIG. 3 is a plot of the resulting cooling differential scanning calorimetry (DSC) traces for the melt processing sample 622 (e.g., $Li_{60}Sn_{20}Zn_{20}$) from above about 800° C., according to a comparative example.

FIG. 3 is a plot of the resulting cooling DSC traces for melt processing sample 622 (MP-622) (e.g., $Li_{60}Sn_{20}Zn_{20}$) for above about 800° C. A series of broad/sharp peaks are observed which indicate the formation of multiple phases of either Li—Sn or Li—Zn. The peak at roughly 500° C. is likely due to either a neat material or binary alloy contaminant.

Figure 4:
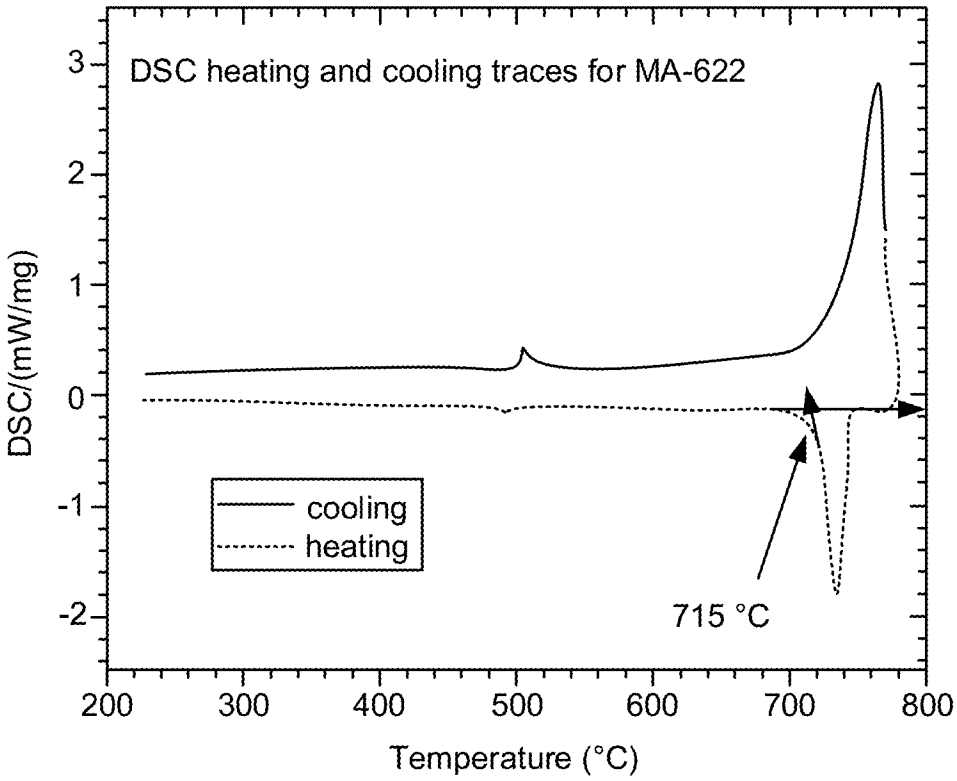
FIG. 4 is a plot of the heating and cooling DSC traces for the mechanically alloyed sample 622 after milling for 6 hours, according to one aspect of the presently disclosed concepts.

FIG. 4 is a plot including the heating and cooling DSC traces for the mechanically alloyed powder sample 622 (MA-622) after milling for 6 hours. Only one peak is observed which indicates that the material comprises a single phase which melts at about 715° C. The peak at roughly 500° C. is likely due to a small amount of unreacted Sn not detected during the heating cycle. The lower temperature DSC peaks as observed in FIG. 3 are not observed here. Specifically, during cooling, other phases as indicated by the 2 additional peaks in the DSC curve depicted in FIG. 3 were not observed.

Figure 5:
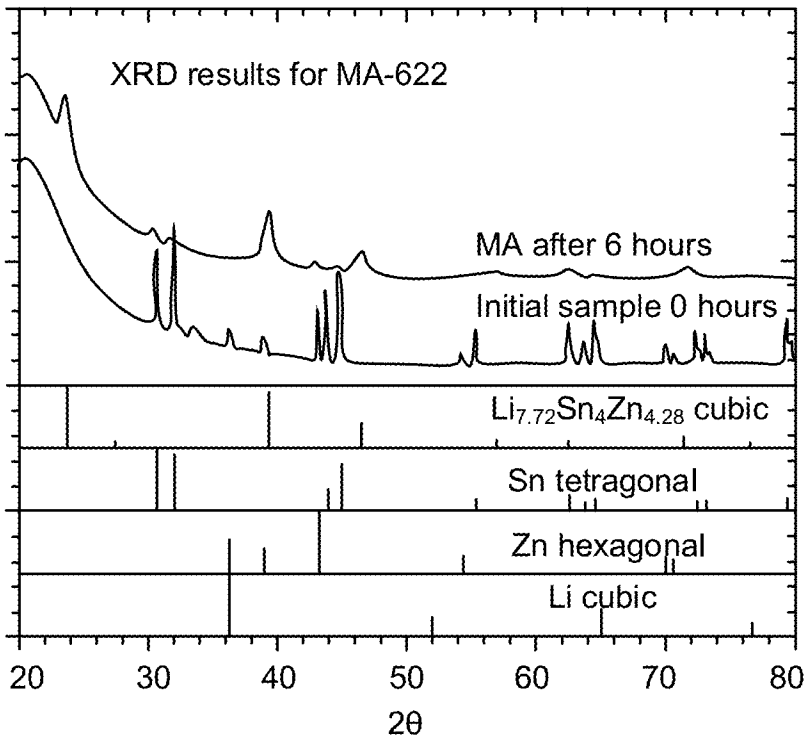
FIG. 5 is a plot of the x-ray diffraction (XRD) result for the mechanically alloyed sample 622, according to one aspect of the presently disclosed concepts.

The XRD results for the mechanically alloyed sample 622 (MA-622) are shown in the plot of FIG. 5, along with the International Centre for Diffraction Data (ICDD) listings for Li, Zn, Sn, and the ternary alloy of Li—Zn—Sn. The strong partial broad peak at the lower 2θ angle is due to the sample holder window. The lower curve indicates that Li, Sn, and Zn were present in the initial powder, as expected. After 6 hours of mechanical alloying, the XRD result is shown on the top plot indicating the presence of the FCC cubic phase, consistent with the published result for $Li_{77.2}Sn_4Zn_{4.28}$ with a minor phase of Sn.

Figure 6:
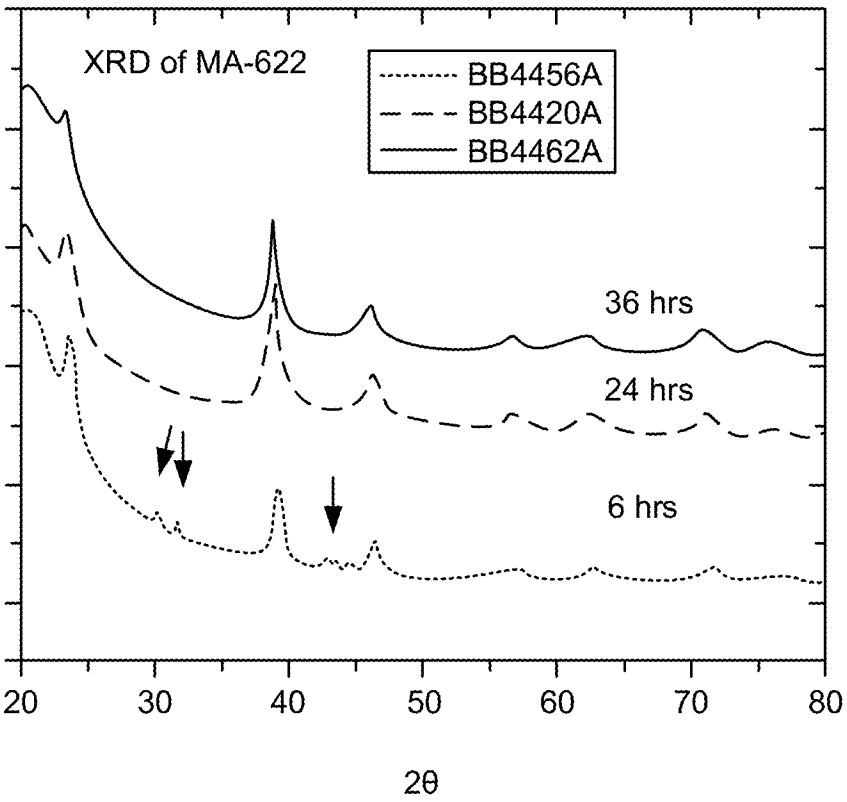
FIG. 6 is a plot comparing XRD spectra for the mechanically alloyed sample 622 at different milling times, according to various aspects of the presently disclosed concepts.

Two additional mechanically alloyed samples (MA-622) with milling times of 24 and 36 hours were prepared and the XRD results are shown in FIG. 6. The single cubic phase is observed. The unreacted Sn as seen in FIG. 5 is not observed for the 24 and 36 milling time samples. The two additional curves for 24 and 36 hour milling times do not show any additional phases. The spectra are evaluated using typical XRD analysis as would be understood by one having ordinary skill in the art, and the crystalline sizes are found to be about 7 nm with lattice spacing of 6.51 nm. The crystalline size and the lattice parameter do not appear to change significantly with increased milling time. The sample remained substantially crystalline after all of the experimental milling times. A sample 721 was also prepared by similar high energetic ball milling techniques. The XRD results for sample 721 (not shown) exhibited similar behavior.

Rietveld analysis (using Jade 9 software, KS Analytical Systems, 5998 Brookstone Ct, Aubrey, TX 76227 USA) was performed on the sample after milling for 24 hours using the model of Pobitschka, et al. (ICDD-PDF #04-015-4321 ($Li_{19.3}Zn_{1.07}Sn$), Pobitschka W., Schuster, U., Z. *Naturforsch., B: Anorg. Chem., Org. Chem.*, v33 p115,1 (1978)) and fixing the concentrations at $Li_{1.93}Zn_{0.07}Sn$. Sn occupies the 4a sites (0, 0, 0). Li resides on the 4b sites (½, ½, ½). Zn and Li share the 4c sites (¼, ¼, ¼) and the 4d sites (¾, ¾, ¾). The fit was observed to be reasonably good with an R-factor of 3.72% as plotted in FIG. 7. It is difficult to refine the concentrations of Li and Zn at the 4c and 4d sites due to the large difference in atomic structure factors between Li and Zn and the data quality.

Figure 7:
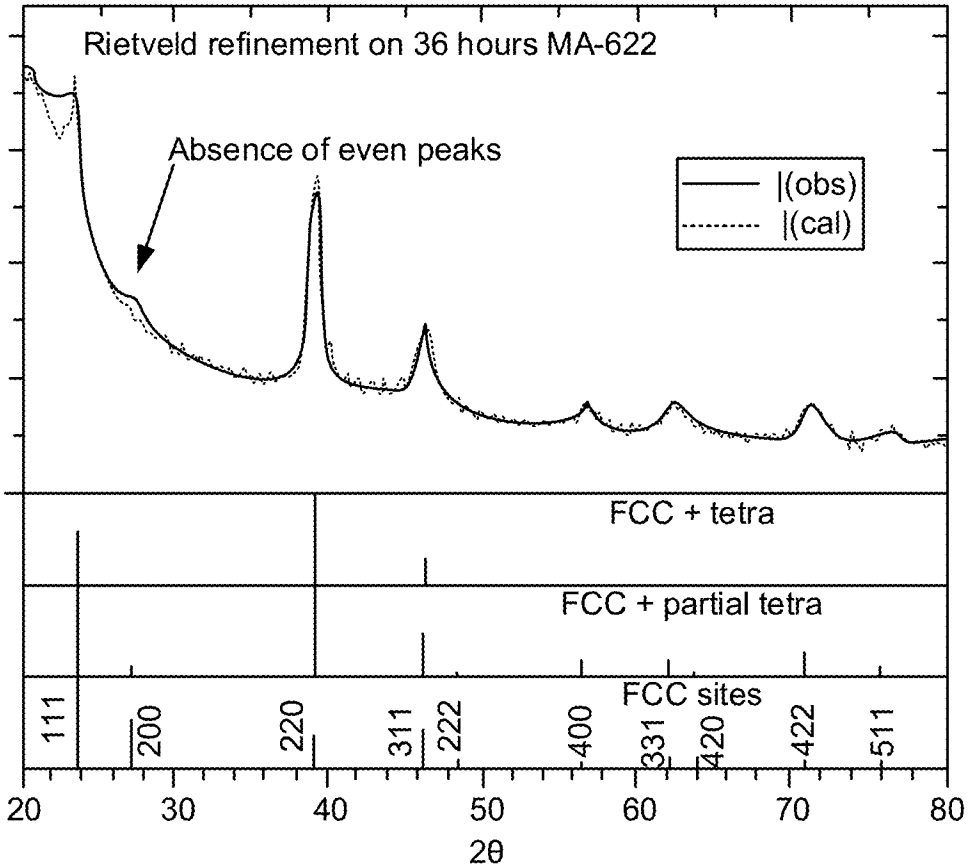
FIG. 7 is a plot of a Rietveld analysis fitting, according to one aspect of the presently disclosed concepts.

The lower plots shown in FIG. 7 compare the simulated XRD peaks for the FCC structure at just the (a) 4a and 4b sites, (b) 4c and 4d sites, and (c) fully filled sites. As expected, the results indicate that "even" peaks (200), (222), and (400) diminish in intensity with increased filling of the 4c and 4d tetrahedral sites. This observation indicates that, in these samples, the tetrahedral sites are filled and shared by the Li and Zn atoms. The results also indicate that non-stochiometric ternary alloys may be synthesized by mechanical alloying.

In summary, at the instantaneous high energy ball collisions, the crystalline phases of Li, Sn, and Zn are melted down to form the FCC cubic structure with Sn atoms situated at the 4a sites of the lattice. Li and Zn atoms are then forced into the tetrahedral sites and the atoms in the tetrahedral phase separate upon cooling, suggesting that chemical order is likely present in the liquid state where 3 Sn atoms encompassed either a Zn or Li atom. The Li and Zn atoms are thereby forced into the tetrahedral sites of the Sn lattice. To accommodate the additional occupancy, Sn conforms into the FCC lattice from the tetragonal structure. Once the FCC structure is formed by mechanical alloying, the atomic connectivity remains indicating that chemical ordering occurred at elevated temperatures above melting. Despite phase separation being more favorable, the inventors were surprised that, upon cooling, the single FCC phase remains.

Figure 8:
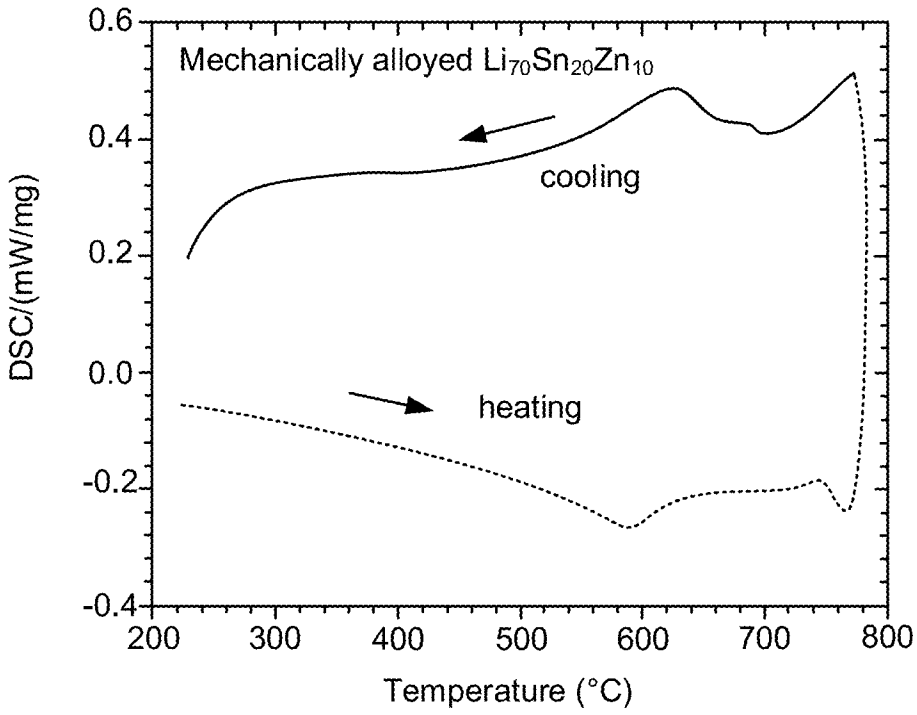
FIG. 8 is a plot of the DSC traces for the mechanically alloyed sample 721 (e.g., $Li_{70}Sn_{20}Zn_{10}$), according to one aspect of the presently disclosed concepts.

FIG. 8 depicts the DSC traces for the mechanically alloyed powder sample 721 (e.g., $Li_{70}Sn_{20}Zn_{10}$) after milling for 6 hours. The DSC traces show the absence of thermal peaks corresponding to the neat or the binary phase structures as shown in FIG. 3. The sample has been converted from the neat Li, Sn, and Zn elements into a less ordered single phase.

Again, the FCC structure of the ternary alloy comprises 4 available sites and atoms sit in these positions in the unit cell defined as (a) (0,0,0), (b) (½, ½, ½), (c) (¼, ¼, ¼), and (d) (¾, ¾, ¾) sites. One product formed according to at least some of the methods described herein comprise Sn atoms sitting at the (a) sites, Li atoms on the (b) sites, and the "extra" Li and Zn atoms sharing the (c) and (d) sites. Accordingly, as would be understood by one having ordinary skill in the art, products formed by the various aspects described herein may be stochiometric or non-stochiometric by filling or partially filling, respectively, various of the (a), (b), (c), and/or (d) sites. For example, sample 622 and sample 721 are both non-stochiometric alloys having sites (c) and (d) partially filled suggesting that the fractional composition can range without changing the cubic structure of the ternary alloy using mechanical alloying.

FIG. 9 is a table summarizing these various permutations of the stochiometric and non-stochiometric ternary alloys capable of formation by mechanical alloying according to various operations described herein. FIG. 9 includes calculations for the possible combinations of concentrations if all the sites are fully occupied according to the formula of $Sn_4Li_4Li_xZn_{(8-x)}$ where x=0 to 8. FIG. 9 also includes the calculated atomic percent Li in the unit cell.

Figure 10:
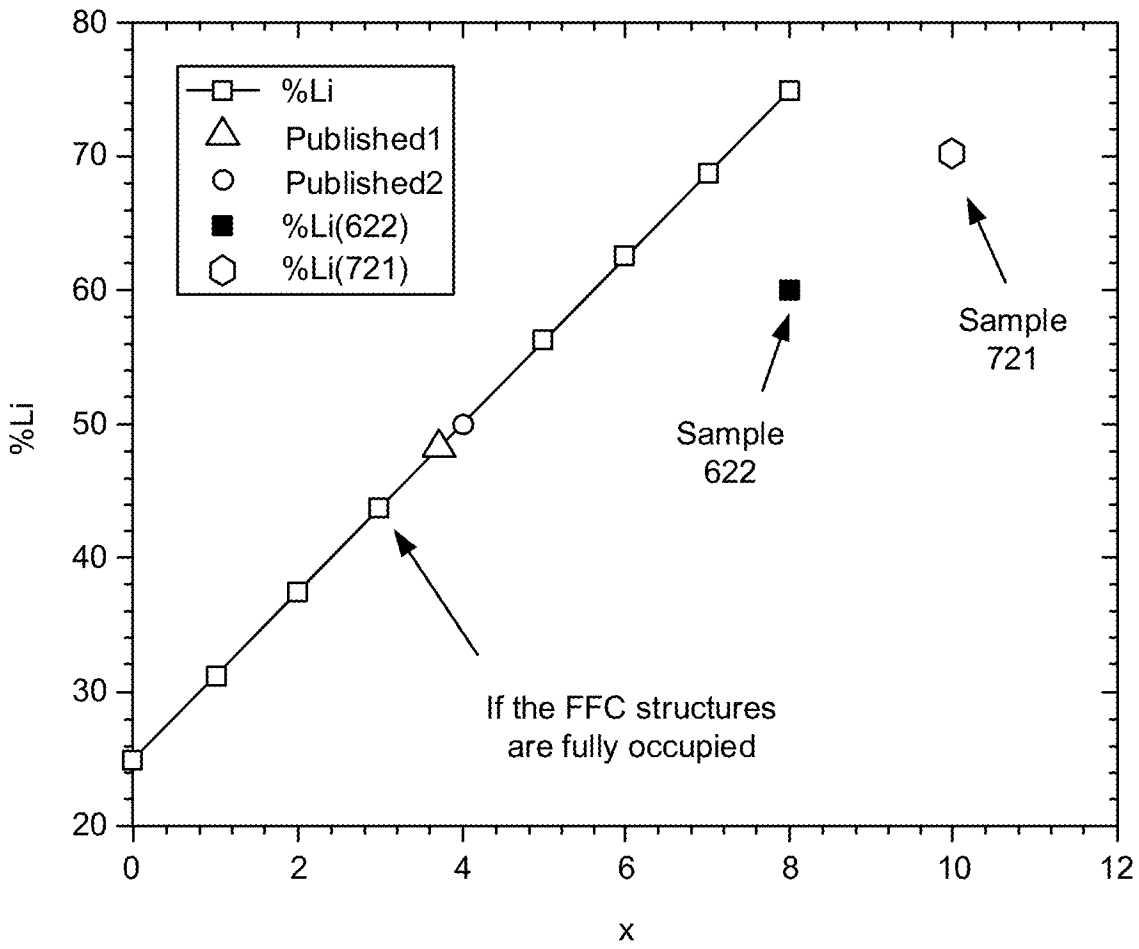
FIG. 10 is a plot of % Li as a function of x, according to one aspect of the presently disclosed inventive concepts.

FIG. 10 is a plot of the resulting (atomic) % Li in the unit cell (e.g., crystal) as a function of x. It is observed that the amount of Li atoms that are embedded into the structure theoretically ranges from about 25 atomic % to about 75 atomic %. This calculation follows a linear relationship indicated by the line drawn on the plot. The two concentrations from the published works (e.g., published1 and published2) agree with the calculations. The published methods of synthesis are by thermal means (e.g., melt processing) and the percent of embedded lithium is about 50 atomic %. The results from the two published results do not deviate from the above linear relationship. The data points are still non-stoichiometric except for published2at the 50 atomic % Li point. $Sn_4Li_4Li_4Zn_4$ is stoichiometric (e.g., the (a) sites have 4 Sn, the (b) sites have 4 Li, the (c) sites have 4 Li, and the (d) sites have 4 Zn) which is the same as $SnLi_2Zn$ (published2) which is also stoichiometric.

The mechanical alloying results from the samples of 622 and 721 indicate that x can go beyond 8 and the amount of Li atoms can be as high as 70%. Sample 622 confirmed that x=8 is possible even though there is 20% of Zn. The (c) and (d) sites need not be fully filled but can also be "overfilled" as shown in FIG. 10 (hexagonal shape) for sample 721. This is the first demonstration that mechanically alloying according to various aspects described herein result in (c) and (d) sites being filled with more than one atom per site which deviates from the above linear relationship rule.

In Use

The present disclosure includes various aspects of synthesizing a ternary alloy which otherwise cannot be prepared by any other way. The inventors believe that the present new material may be used in many applications where the storage of lithium is important, including fusion reactors, battery anode technology, etc. From a physical material properties point of view, the addition of Li will lighten the desired materials as well as improve the packing at nano-scale.

In various approaches, a ternary alloy formed according to at least some of the approaches disclosed herein may be used in nuclear fusion reactor blanket technology. Lithium is very reactive with air and moisture. A ternary alloy comprising lithium as presented herein may provide a route for using lithium in fusion reactor applications while reducing or eliminating unwanted reactions between lithium and the environment.

In other approaches, a ternary alloy formed according to at least some of the approaches disclosed herein may be used in battery technology by taking advantage of the tunable compositions described in detail above. Various non-stoichiometric forms of the ternary alloy may be used in Li-ion battery anode applications where a small change in composition influences the performance of the material. Anode materials are conventionally the limiting factor in battery technology. The tunable nature of at least some of the ternary alloys described herein may be beneficial for overcoming this limitation.

In yet further approaches, a ternary alloy formed according to at least some of the approaches disclosed herein may be used in aviation applications. Aviation applications would benefit from a lightweight ternary alloy having at least some of the characteristics described in detail herein.

The inventive concepts disclosed herein have been presented by way of example to illustrate the myriad features thereof in a plurality of illustrative scenarios, aspects, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various aspects have been described above, it should be understood that they have been presented by way of example only, and not limitation. Thus, the breadth and scope of an aspect of the present invention should not be limited by any of the above-described exemplary aspects, but should be defined only in accordance with the following claims and their equivalents.

What is claimed is:

1. A product, comprising:

a ternary alloy consisting essentially of $Sn_4Li_{(4+x)}Zn_{(8-x)}$, where x=0 to <8.

2. The product as recited in claim 1, wherein the ternary alloy is physically characterized by remaining substantially in a single face center cubic (FCC) phase upon heating to about 900° C.

3. The product as recited in claim 2, wherein the ternary alloy is physically characterized by remaining substantially in the single FCC phase upon cooling from the about 900° C.

4. The product as recited in claim 1, wherein the ternary alloy is non-stochiometric.

5. The product as recited in claim 1, wherein the ternary alloy has physical characteristics of formation by a mechanical alloying process.

6. The product as recited in claim 5, wherein the mechanical alloying process includes high energy ball milling.

7. The product as recited in claim 1, comprising a body comprising sintered nanoparticles of the ternary alloy integrated therein.

8. The product as recited in claim 7, wherein the body comprises carbon fibers.

9. The product as recited in claim 7, wherein the body comprises a magnetic element, wherein the magnetic element is selected from the group consisting of: Fe, Co, Cr, and Ni.

10. The product as recited in claim 1, wherein x=0 to <3.5.

11. The product as recited in claim 1, wherein x=0 to <3.

12. The product as recited in claim 1, wherein x=4 to <8.

13. The product as recited in claim 1, wherein x=4.5 to <8.

14. A method for forming the product of claim 1, the method comprising:

forming the ternary alloy consisting essentially of $Sn_4Li_{(4+x)}Zn_{(8-x)}$, where x=0 to <8 using a mechanical alloying process.

15. The method as recited in claim 14, wherein the mechanical alloying process includes high energy ball milling.

16. The method as recited in claim 14, wherein forming the ternary alloy comprises changing a stochiometric composition in the ternary alloy.

17. The method as recited in claim 14, wherein the ternary alloy is physically characterized by remaining substantially in a single face center cubic (FCC) phase upon heating to about 900° C.

18. The method as recited in claim 17, wherein the ternary alloy is physically characterized by remaining substantially in the single FCC phase upon cooling from the about 900° C.

19. The method as recited in claim 14, comprising sintering nanoparticles of the ternary alloy.

20. The method as recited in claim 19, comprising forming a body comprising the sintered nanoparticles of the ternary alloy integrated therein.

* * * * *